US012442204B2

(12) United States Patent
Susi

(10) Patent No.: US 12,442,204 B2
(45) Date of Patent: Oct. 14, 2025

(54) SCAFFOLDING SYSTEM

(71) Applicant: Philip Susi, West Babylon, NY (US)

(72) Inventor: Philip Susi, West Babylon, NY (US)

( * ) Notice: Subject to any disclaimer, the term of this patent is extended or adjusted under 35 U.S.C. 154(b) by 0 days.

(21) Appl. No.: 18/414,555

(22) Filed: Jan. 17, 2024

(65) Prior Publication Data

US 2025/0230676 A1 Jul. 17, 2025

(51) Int. Cl.

*E04G 1/22* (2006.01)
*E04G 1/08* (2006.01)
*E04G 1/28* (2006.01)

(52) U.S. Cl.

CPC ..... *E04G 1/22* (2013.01); *E04G 1/08* (2013.01); *E04G 1/28* (2013.01)

(58) Field of Classification Search

CPC ... E04G 1/22; E04G 7/02; E04B 1/003; A47F 5/0815; A01M 31/02; B60R 2011/0066; F16B 5/0036; F16B 12/34; F16B 21/09; A47B 57/402

See application file for complete search history.

(56) References Cited

U.S. PATENT DOCUMENTS 56,437 A * 7/1866 Newbanks ..... B66F 11/04 182/222
265,881 A * 10/1882 Smith ..... B66F 11/04 187/270
418,938 A * 1/1890 Bogusch ..... E04G 1/32 108/115
1,776,565 A * 9/1930 Morton ..... E04G 3/28 182/163
2,305,563 A * 12/1942 Uecker ..... E04G 1/14 52/693
2,569,653 A * 10/1951 Boedecker ..... E04G 1/20 182/69.6
2,585,763 A * 2/1952 Gasner ..... E04G 5/02 182/101
2,803,503 A * 8/1957 Borgman ..... E04G 1/20 182/132
2,916,102 A * 12/1959 Reinhardt ..... E04G 3/30 182/152

(Continued)

FOREIGN PATENT DOCUMENTS

CN 114182940 A * 3/2022

OTHER PUBLICATIONS

Translation (Year: 2024).*

*Primary Examiner* — Brian D Mattei
*Assistant Examiner* — Kathleen M. McFarland
(74) *Attorney, Agent, or Firm* — Carter, DeLuca & Farrell, LLP; John R. Sepúlveda

(57) ABSTRACT

A scaffolding system includes a plurality of leg assemblies and a plurality of arch assemblies. Each leg assembly includes at least one through-hole disposed through a top end portion. Each arch assembly includes a top chord and a bottom chord connected by a plurality of vertical members such that the top chord and the bottom chord are vertically aligned. At least one of the first end of the top chord or the first end of the bottom chord connects to a leg assembly via the at least one through-hole. At least one of the second end of the top chord or the second end of the bottom chord connects to a different leg assembly via the at least one through-hole. The plurality of leg assemblies is configured to support a plurality of deck sections.

20 Claims, 10 Drawing Sheets

(56) References Cited

U.S. PATENT DOCUMENTS 2,997,126 A * 8/1961 Morgen ..... E04G 1/20 182/148
3,994,036 A * 11/1976 Fisher ..... E04G 3/30 182/222
4,891,926 A * 1/1990 Allenbaugh ..... E04G 1/14 52/696
5,299,445 A * 4/1994 Yee ..... E04C 3/44 52/745.19
5,305,572 A * 4/1994 Yee ..... E04C 3/26 52/690
5,727,272 A * 3/1998 Peter ..... E01D 1/00 14/13
6,085,867 A * 7/2000 Daniel, III ..... E04F 11/112 182/115
6,742,311 B2 * 6/2004 Fortier ..... E04B 1/003 52/185
6,832,666 B2 * 12/2004 Stringer ..... E04G 1/20 182/141
6,915,615 B2 * 7/2005 Won ..... E01D 6/00 52/693
7,228,936 B2 * 6/2007 Wyse ..... E06C 1/39 182/12
9,260,873 B1 * 2/2016 Curtis ..... E04G 1/14
9,580,919 B2 * 2/2017 Keersmaekers ..... E04G 5/007
10,640,983 B2 * 5/2020 Honeycutt ..... E04G 27/00
D890,957 S * 7/2020 Kuka ..... D25/63
11,613,898 B2 * 3/2023 Garcia ..... E04G 5/061 182/222
2003/0182883 A1 * 10/2003 Won ..... E01D 6/00 52/223.6
2004/0050010 A1 * 3/2004 Fortier ..... E04B 1/003 52/650.3
2004/0188176 A1 * 9/2004 Wyse ..... E06C 1/397 182/118
2006/0027423 A1 * 2/2006 Wyse ..... E06C 1/397 182/170
2011/0290588 A1 * 12/2011 Hall ..... E04B 1/003 182/113
2017/0356198 A1 * 12/2017 Rowsome ..... E04G 1/24
2022/0316222 A1 * 10/2022 Smith ..... E04G 1/24
2023/0064495 A1 * 3/2023 Stefan ..... E04G 7/02

* cited by examiner

SCAFFOLDING SYSTEM

TECHNICAL FIELD

The present disclosure relates generally to the field of construction. More specifically, the present disclosure relates to scaffolding systems.

BACKGROUND

Scaffolding systems can often require many different components and can be complicated to assemble. For example, numerous braces may be needed in order to form a solid, stable connection between each vertical support and an upper deck of a scaffolding system. Additionally, meeting robust building code requirements adds to the challenge of assembling scaffolding systems.

SUMMARY

According to an aspect of the present disclosure, a scaffolding system includes a plurality of leg assemblies and a plurality of arch assemblies. Each leg assembly of the plurality of leg assemblies includes a top end surface and a bottom end surface. Each leg assembly of the plurality of leg assemblies includes at least one through-hole disposed in a top end portion. Each arch assembly of the plurality of arch assemblies comprises a top chord, a bottom chord, and a plurality of vertical members. The top chord includes a first end and a second end, the bottom chord includes a first end and a second end, and each vertical member of the plurality of vertical members includes a top end and a bottom end. The top chord connects to the top end of each vertical member of the plurality of vertical members and the bottom chord connects to the bottom end of each vertical member of the plurality of vertical members such that the first end of the top chord and the first end of the bottom chord are vertically aligned and the second end of the top chord and second end of the bottom chord are vertically aligned. At least one of the first end of the top chord or the first end of the bottom chord is configured to connect to a first leg assembly of the plurality of leg assemblies via the at least one through-hole. At least one of the second end of the top chord or the second end of the bottom chord is configured to connect to a second leg assembly of the plurality of leg assemblies via the at least one through-hole. The plurality of leg assemblies is configured to support a plurality of deck sections.

In another aspect of the present disclosure, each leg assembly of the plurality of leg assemblies may include a square horizontal cross-section.

In yet another aspect of the present disclosure, each leg assembly of the plurality of leg assemblies may include an adjustable height.

In a further aspect of the present disclosure, a central vertical axis of each leg assembly of the plurality of leg assemblies may be placed at least ten feet apart from the central vertical axis of each remaining leg assembly of the plurality of leg assemblies.

In another aspect of the present disclosure, each arch assembly may further comprise a panel, wherein the panel includes a top end and a bottom end. The panel may be disposed at a central location of both the top chord and the bottom chord. The top end of the panel may connect to the top chord and the bottom end of the panel may connect to the bottom chord.

In yet another aspect of the present disclosure, the bottom end surface of each leg assembly of the plurality of leg assemblies may define a first horizontal plane. The first end of the bottom chord and the second end of the bottom chord may define a second horizontal plane. A clearance height of at least eight feet may be established beneath each arch assembly of the plurality of arch assemblies between the first horizontal plane and the second horizontal plane.

In a further aspect of the present disclosure, the first end of the bottom chord and the second end of the bottom chord may define a horizontal plane. The bottom chord may be curved such that a vertex of the bottom chord is located above the horizontal plane at a center point of the bottom chord. Each vertical member of the plurality of vertical members may decrease in vertical length moving from the first end of the bottom chord to the center point of the bottom chord and increase in vertical length moving from the center point of the bottom chord to the second end of the bottom chord.

In another aspect of the present disclosure, the first end of the top chord may include a first end plate disposed thereon. The second end of the top chord may include a second end plate disposed thereon. The first end of the bottom chord may include a first end plate disposed thereon. The second end of the bottom chord may include a second end plate disposed thereon. At least one of the first end of the top chord or the first end of the bottom chord may connect to the at least one through-hole of the first leg assembly of the plurality of leg assemblies via at least one of the first end plate of the top chord or the first end plate of the bottom chord, and at least one of the second end of the top chord or the second end of the bottom chord may connect to the at least one through-hole of the second leg assembly of the plurality of leg assemblies via at least one of the second end plate of the top chord or the second end plate of the bottom chord.

In yet another aspect of the present disclosure, the at least one through-hole of each leg assembly of the plurality of leg assemblies may be configured to receive a threaded insert. At least one of the first end of the top chord or the first end of the bottom chord may connect to the first leg assembly of the plurality of leg assemblies via the threaded insert. At least one of the second end of the top chord or the second end of the bottom chord may connect to the second leg assembly of the plurality of leg assemblies via the threaded insert.

In a further aspect of the present disclosure, the top end surface and bottom end surface of each leg assembly of the plurality of leg assemblies may be parallel.

In another aspect of the present disclosure, the plurality of leg assemblies and the plurality of arch assemblies may be arranged in a grid pattern.

In yet another aspect of the present disclosure, the scaffolding system may further include a plurality of false ceiling sections, wherein the plurality of arch assemblies may be configured to support the plurality of false ceiling sections.

According to another aspect of the present disclosure, a scaffolding system includes a plurality of leg assemblies and a plurality of arch assemblies. Each leg assembly of the plurality of leg assemblies includes a top end surface and a bottom end surface, the top end surface and bottom end surface being parallel. Each leg of the plurality of leg assemblies includes an upper through-hole and a lower through-hole disposed in a top end portion. The upper through-hole and the lower through-hole are each configured to receive a threaded insert. Each arch assembly of the plurality of arch assemblies comprises a top chord, a bottom chord, and a plurality of vertical members. The top chord includes a first end and a second end, the first end of the top chord including a first end plate disposed thereon and the second end of the top chord including a second end plate disposed thereon. The bottom chord includes a first end and a second end, the first end of the bottom chord including a first end plate disposed thereon and the second end of the bottom chord including a second end plate disposed thereon. The first end of the bottom chord and the second end of the bottom chord define an upper horizontal plane. Each vertical member of the plurality of vertical members includes a top end and a bottom end. The top chord connects to the top end of each vertical member of the plurality of vertical members and the bottom chord connects to the bottom end of each vertical member of the plurality of vertical members such that the first end plate of the top chord and the first end plate of the bottom chord are vertically aligned and the second end plate of the top chord and second end plate of the bottom chord are vertically aligned. The bottom chord is curved such that a vertex of the bottom chord is located above the upper horizontal plane at a center point of the bottom chord. Each vertical member of the plurality of vertical members decreases in vertical length moving from the first end of the bottom chord to the center point of the bottom chord and increases in vertical length moving from the center point of the bottom chord to the second end of the bottom chord. The first end plate of the top chord is configured to connect to a first leg assembly of the plurality of leg assemblies via the threaded insert of the upper through-hole. The first end plate of the bottom chord is configured to connect to the first leg assembly of the plurality of leg assemblies via the threaded insert of the lower through-hole. The second end plate of the top chord is configured to connect to a second leg assembly of the plurality of leg assemblies via the threaded insert of the upper through-hole. The second end plate of the bottom chord is configured to connect to the second leg assembly of the plurality of leg assemblies via the threaded insert of the lower through-hole. The plurality of leg assemblies is configured to support a plurality of deck sections.

In another aspect of the present disclosure, each leg assembly of the plurality of leg assemblies may include a square horizontal cross-section.

In yet another aspect of the present disclosure, each leg assembly of the plurality of leg assemblies may further comprise a pin assembly, a main tube including a pin through-hole, and a base tube including a plurality of pin through-holes. The pin assembly may be configured to be received by the pin through-hole of the main tube and a pin through-hole of the plurality of pin through-holes of the base tube. A height of each leg assembly of the plurality of leg assemblies may be adjusted by aligning the pin through-hole of the main tube with a pin through-hole of the plurality of pin through-holes of the base tube, and installing the pin assembly within the pin through-hole of the main tube and the pin through-hole of the plurality of pin through-holes of the base tube.

In a further aspect of the present disclosure, a central vertical axis of each leg assembly of the plurality of leg assemblies may be placed at least ten feet apart from the central vertical axis of each remaining leg assembly of the plurality of leg assemblies.

In another aspect of the present disclosure, each arch assembly may further comprise a panel. The panel may include a top end and a bottom end. The panel may be disposed at a central location of both the top chord and the bottom chord, the top end of the panel connecting to the top chord and the bottom end of the panel connecting to the bottom chord.

In yet another aspect of the present disclosure, the bottom end surface of each leg assembly of the plurality of leg assemblies may define a lower horizontal plane. A clearance height of at least eight feet may be established beneath each arch assembly of the plurality of arch assemblies between the upper horizontal plane and the lower horizontal plane.

In a further aspect of the present disclosure, the plurality of leg assemblies and the plurality of arch assemblies may be arranged in a grid pattern.

According to one aspect of the present disclosure, a scaffolding system includes a plurality of leg assemblies and a plurality of arch assemblies. Each leg assembly of the plurality of leg assemblies includes a top end surface and a bottom end surface, the bottom end surface defining a first horizontal plane. The top end surface and bottom end surface are parallel. Each leg assembly of the plurality of leg assemblies includes a square horizontal cross-section, and an adjustable height. A central vertical axis of each leg assembly of the plurality of leg assemblies is placed at least ten feet apart from the central vertical axis of each remaining leg assembly of the plurality of leg assemblies. Each leg of the plurality of leg assemblies includes an upper through-hole and a lower through-hole disposed in a top end portion. The upper through-hole and the lower through-hole are each configured to receive a threaded insert. Each arch assembly of the plurality of arch assemblies comprises a top chord, a bottom chord, a panel, and a plurality of vertical members. The top chord includes a first end and a second end. The first end of the top chord includes a first end plate disposed thereon. The second end of the top chord includes a second end plate disposed thereon. The bottom chord includes a first end and a second end. The first end of the bottom chord includes a first end plate disposed thereon. The second end of the bottom chord includes a second end plate disposed thereon. The first end of the bottom chord and the second end of the bottom chord define a second horizontal plane. The panel includes a top end and a bottom end. Each vertical member of the plurality of vertical members includes a top end and a bottom end. The top chord connects to the top end of each vertical member of the plurality of vertical members and the bottom chord connects to the bottom end of each vertical member of the plurality of vertical members such that the first end plate of the top chord and the first end plate of the bottom chord are vertically aligned and the second end plate of the top chord and second end plate of the bottom chord are vertically aligned. The bottom chord is curved such that a vertex of the bottom chord is located above the second horizontal plane at a center point of the bottom chord. Each vertical member of the plurality of vertical members decreases in vertical length moving from the first end of the bottom chord to the center point of the bottom chord and increases in vertical length moving from the center point of the bottom chord to the second end of the bottom chord. The panel is disposed at a central location of both the top chord and the bottom chord. The top end of the panel connects to the top chord and the bottom end of the panel connects to the bottom chord. The first end plate of the top chord is configured to connect to a first leg assembly of the plurality of leg assemblies via the threaded insert of the upper through-hole. The first end plate of the bottom chord is configured to connect to the first leg assembly of the plurality of leg assemblies via the threaded insert of the lower through-hole. The second end plate of the top chord is configured to connect to a second leg assembly of the plurality of leg assemblies via the threaded insert of the upper through-hole. The second end plate of the bottom chord is configured to connect to the second leg assembly of the plurality of leg assemblies via the threaded insert of the lower through-hole. A clearance height of at least eight feet is established beneath each arch assembly of the plurality of arch assemblies between the first horizontal plane and the second horizontal plane. The plurality of leg assemblies and the plurality of arch assemblies are arranged in a grid pattern. The plurality of leg assemblies are configured to support a plurality of deck sections. The plurality of arch assemblies are configured to support a plurality of false ceiling sections.

Further details and aspects of the present disclosure are described in more detail below with reference to the appended drawings.

BRIEF DESCRIPTION OF THE DRAWINGS

A better understanding of the features and advantages of the present disclosure will be obtained by reference to the following detailed description that sets forth illustrative aspects, in which the principles of the present disclosure are utilized, and the accompanying drawings of which.

DETAILED DESCRIPTION

Figure 1:
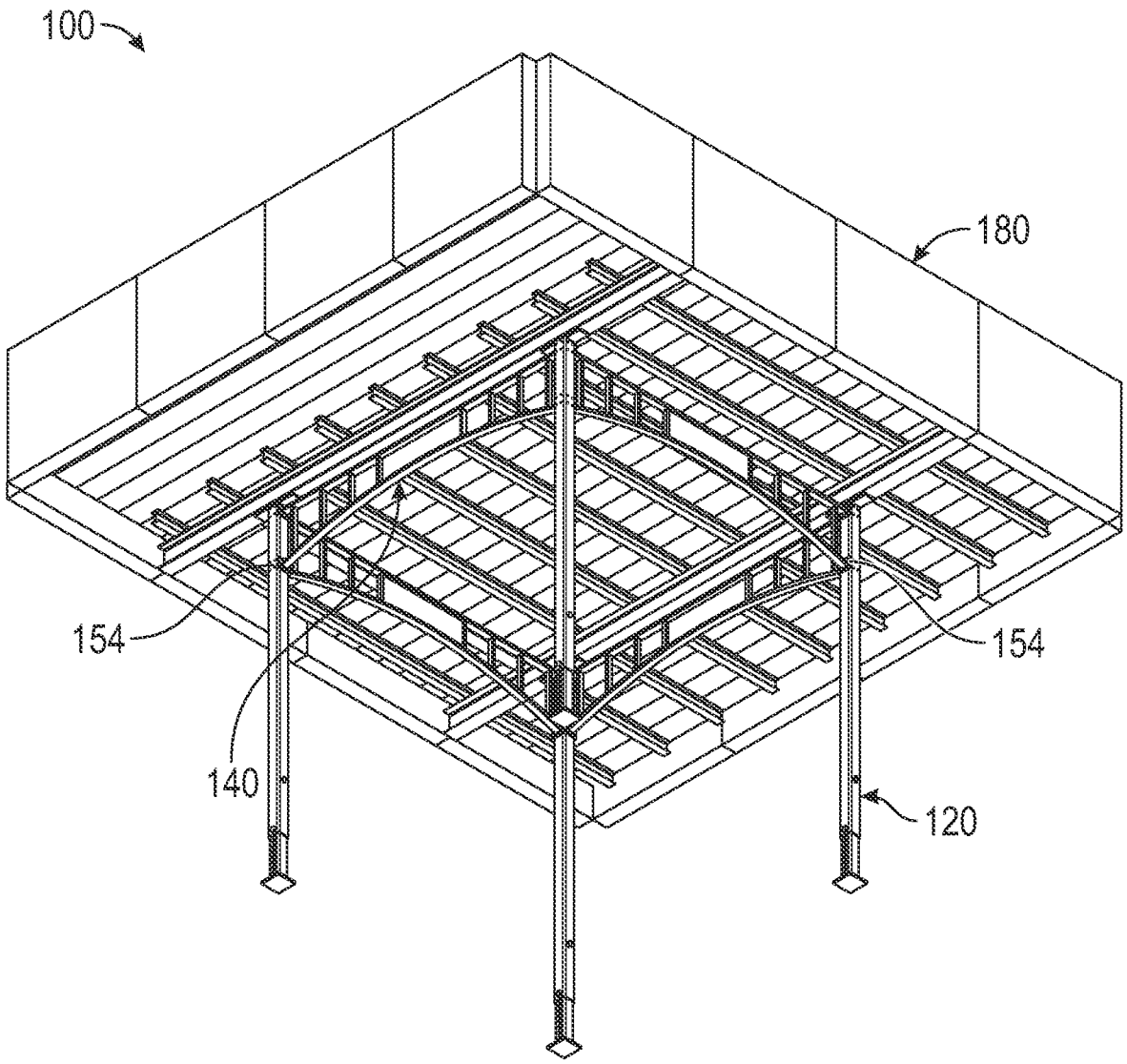
FIG. 1 is a bottom perspective view of a single bay scaffolding system in accordance with aspects of the present disclosure.

Aspects of the present disclosure are described in detail with reference to the drawings wherein like reference numerals identify similar or identical elements.

Although the present disclosure will be described in terms of specific aspects and examples, it will be readily apparent to those skilled in this art that various modifications, rearrangements, and substitutions may be made without departing from the spirit of the present disclosure.

For purposes of promoting an understanding of the principles of the present disclosure, reference will now be made to exemplary aspects illustrated in the drawings, and specific language will be used to describe the same. It will nevertheless be understood that no limitation of the scope of the present disclosure is thereby intended. Any alterations and further modifications of the novel features illustrated herein, and any additional applications of the principles of the present disclosure as illustrated herein, which would occur to one skilled in the relevant art and having possession of this disclosure, are to be considered within the scope of the present disclosure. For illustrative purposes, the following detailed description is directed to scaffolding systems, which may be in the form of a sidewalk bridge, a pedestrian protection system, an open space and lobby overhead protection system, a work platform and/or the like.

Figure 2:
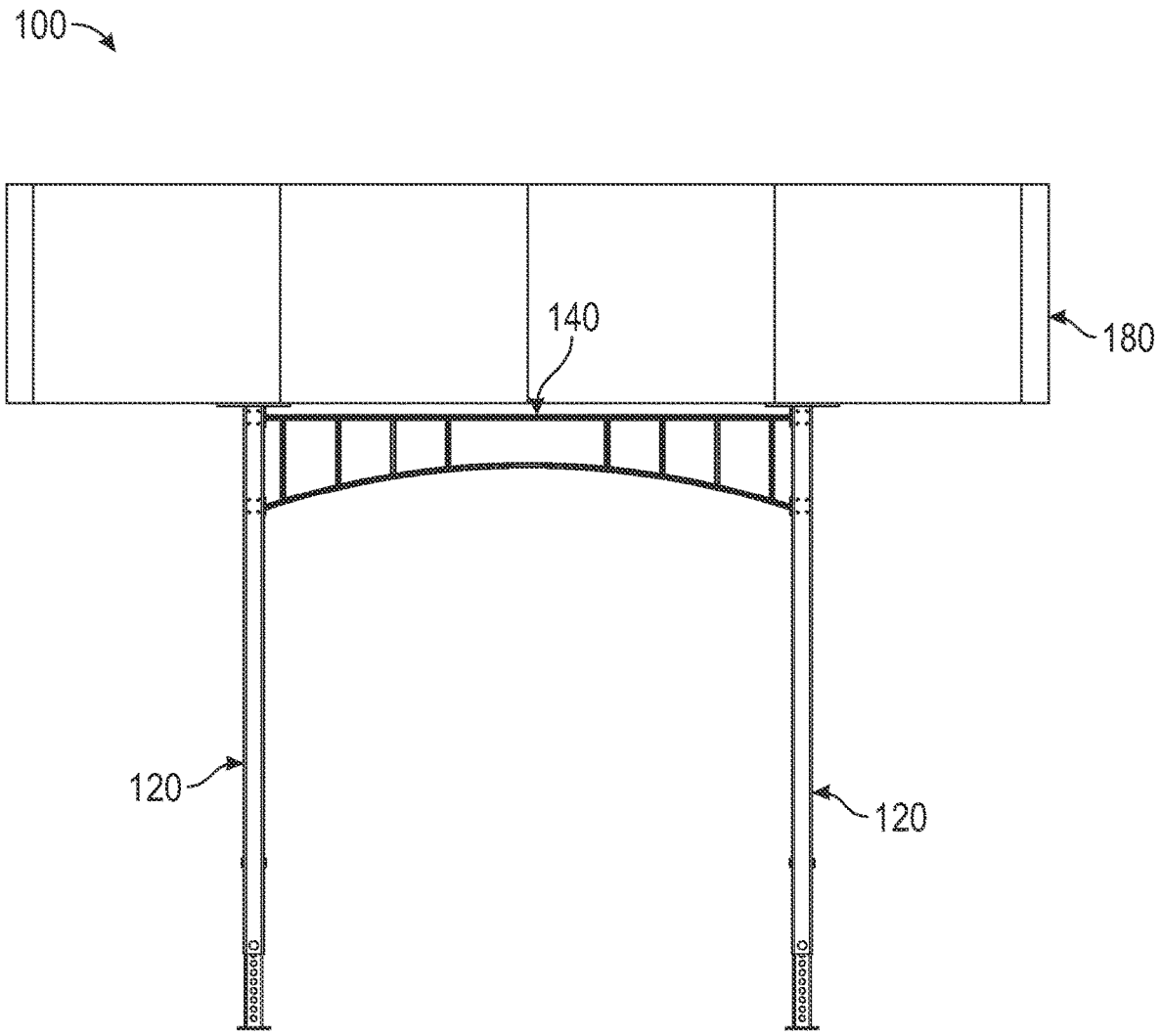
FIG. 2 is a front view of the scaffolding system of FIG. 1.

FIGS. 1 and 2, respectively, portray a bottom perspective view and a front view of a scaffolding system 100. Although a single bay configuration of the scaffolding system 100 is shown, multiple bays are contemplated. The scaffolding system 100 generally includes one or more leg assemblies 120 and one or more arch assemblies 140 configured to support a deck 180 atop leg assemblies 120. Leg assemblies 120 may be connected to arch assemblies 140 using any suitable securement technique such as fastening (e.g., via one or more fasteners like a bolt 154), welding, friction-fit, snap-fit, etc. Although one deck 180 is described herein, it is contemplated that more than one deck 180 may be supported by leg assemblies 120 and arch assemblies 140.

Figure 3:
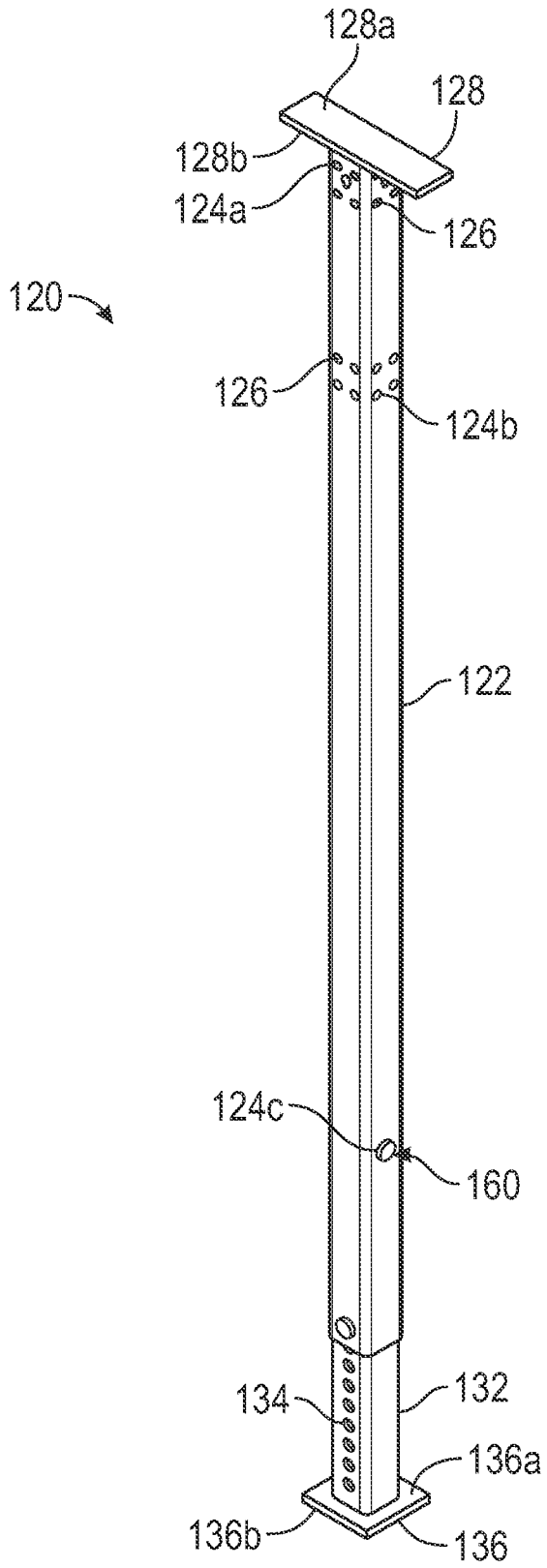
FIG. 3 is a top perspective view of a leg assembly of the scaffolding system of FIG. 1.
Figure 4:
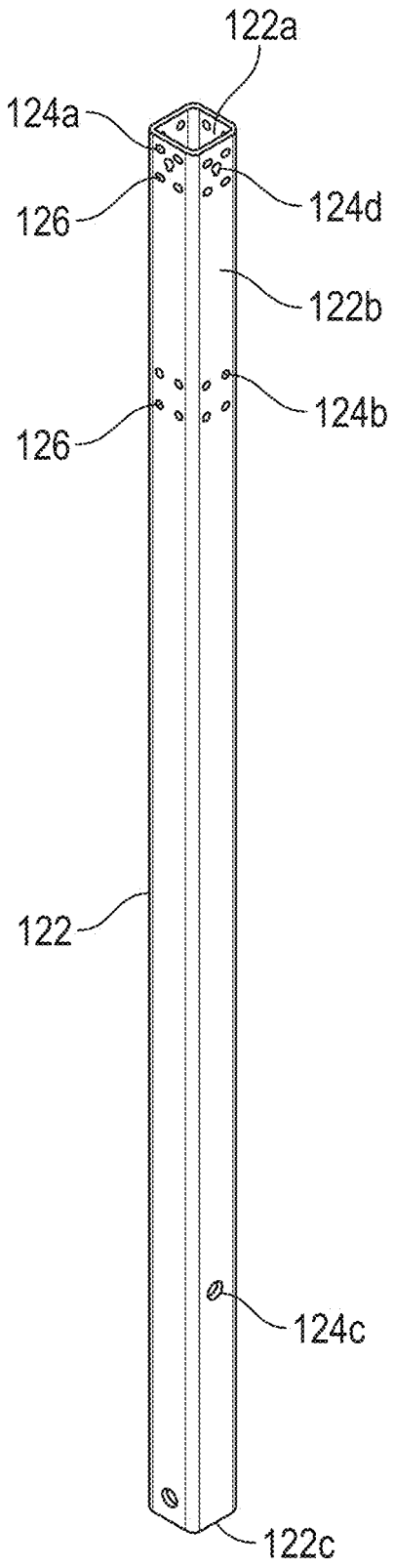
FIG. 4 is a top perspective view of a main tube of the leg assembly of FIG. 3.
Figure 5:
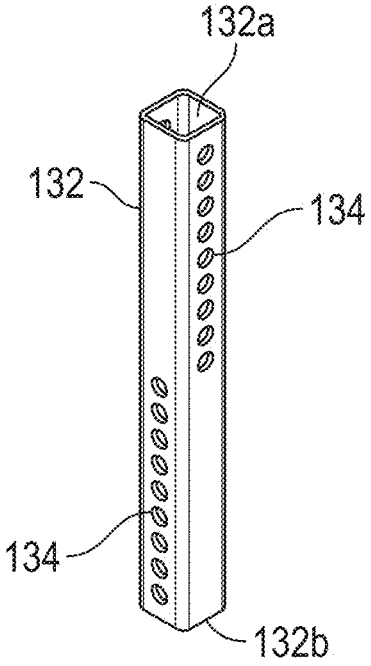
FIG. 5 is a top perspective view of a base tube of the leg assembly of FIG. 3.

Referring to FIGS. 3-5, leg assembly 120 of scaffold system 100 generally includes a main tube 122, a base tube 132, a head plate 128, and a base plate 136. Leg assembly 120, or one or more components thereof, may be formed from any suitable rigid material such as a metallic material like steel, carbon steel, or the like. Main tube 122 of leg assembly 120 includes a top end surface 122*a*, a top portion 122*b*, and a bottom end surface 122*c* (FIG. 4). Head plate 128 of leg assembly 120 includes a top surface 128*a* and a bottom surface 128*b*. Bottom surface 128*b* of head plate 128 may be attached to top end surface 122*a* of main tube 122. Base tube 132 of leg assembly 120 includes a top end surface 132*a* and a bottom end surface 132*b* (FIG. 5), and base plate 136 of leg assembly 120 includes a top surface 136*a* and a bottom surface 136*b*. Top surface 136*a* of base plate 136 may be attached to bottom end surface 132*b* of base tube 132. Head plate bottom surface 128*b* may be connected to main tube top end surface 122*a*, and base plate top surface 136*a* may be connected to base tube bottom end surface 132*b* using any suitable securement technique such as welding, mechanical fastening, adhesive bonding, or the like. Main tube 122 and base tube 132 may each be hollow and may each have a square tubular cross-section, though other suitably shaped cross-sections are contemplated. For example, a circular, elliptic, triangular, or alternate quadrilateral cross-section may be acceptable.

Main tube 122 may have upper through-hole(s) 124*a* and lower through-hole(s) 124*b*, each disposed through top portion 122*b* of main tube 122. Main tube 122 may have pin through-hole(s) 124*c*, disposed through a bottom portion of main tube 122. Main tube 122 may have an elongated through-hole 124*d* disposed through top portion 122*b* of main tube 122. Elongated through-hole 124*d* may be shaped to include a first circle overlapping a second circle. The first circle may have a larger diameter than the second circle. For example, the first circle may be sized to permit passage of a head of a fastener, such as a bolt or a screw. The second circle may be sized to permit passage of a body portion of the fastener, and not the head of the fastener. Other suitable shapes of elongated through-hole 124*d* are contemplated as well. In aspects, elongated through-hole 124*d* may be approximately centrally located on main tube 122 between the upper through-holes 124*a*.

Base tube 132 of leg assembly 120 is sized such that base tube 132 may fit within an interior aperture of main tube 122. That is, base tube 132 may be received within main tube 122. Base tube 132 may have pin through-hole(s) 134, corresponding to pin through-hole 124*c* of main tube 122, disposed through base tube 132. Main tube 122 may be connected to base tube 132 by aligning pin through-hole 124*c* of main tube 122 with pin through-hole 134 of base tube 132. Pin through-hole 124*c* and pin through-hole 134 are each sized to receive one or more pin assemblies 160 therethrough. Each pin assembly 160 may be installed through pin through-hole 124*c* and pin through-hole 134 to hold main tube 122 and base tube 132 together.

Figure 6:
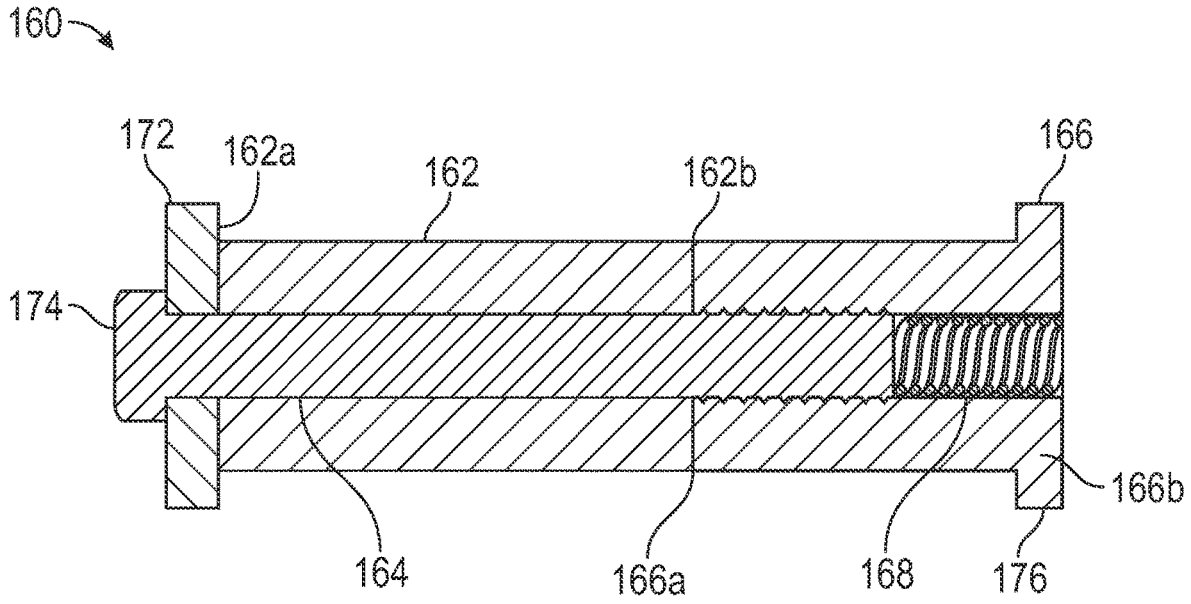
FIG. 6 is a bisected side-view of a pin assembly of the scaffolding system of FIG. 1.

With reference to FIG. 6, pin assembly 160 is shown. Pin assembly 160 may include a first pin half 162 including a through-hole 164, a second pin half 166 including a threaded hole 168, a washer 172, and a bolt 174. First pin half 162 and second pin half 166 are portrayed as being cylindrical, but may be any other suitable shape. First pin half 162 and second pin half 166 may be comprised of any suitable rigid material such as a metallic material like steel or carbon steel. Manufacturing the first pin half 162 and second pin half 166 from steel may provide the benefits of increased strength, durability, and ability to withstand high pressure. First pin half 162 includes a first end surface 162*a* and a second end surface 162*b*, with through-hole 164 disposed through both first end surface 162*a* and second end surface 162*b*. Through-hole 164 is of a diameter such that bolt 174 is permitted to pass therethrough. First pin half 162 is sized such that first pin half 162 may be received through pin through-hole 124*c* and pin through-hole 134. Second pin half 166 includes a first end surface 166*a* and a second end surface 166*b*, with threaded hole 168 configured to align with through-hole 164 and disposed through both first end surface 166*a* and second end surface 166*b*. Threaded hole 168 is threaded such that bolt 174 may be installed into threaded hole 168.

Second pin half 166 may include a protrusion 176 toward second end surface 166*b* of second pin half 166, such that second end surface 166*b* of second pin half 166 includes a larger diameter than first end surface 166*a*. Thus, a portion of second pin half 166 may be received within pin through-hole 124*c* and pin through-hole 134, while the protrusion 176 is larger than pin through-hole 124*c* and pin through-hole 134 and rests on an exterior surface of main tube 122. In aspects, it is contemplated that rather than including protrusion 176, another washer 172 may be disposed on the second end surface 166*b* of second pin half 166, such that the washer 172, instead of the protrusion 176, rests on the exterior surface of main tube 122. Washer 172 may be secured in place by another bolt 174.

To install pin assembly 160 within scaffolding system 100, and therefore connect main tube 122 and base tube 132, first pin half 162 is inserted through pin through-hole 124*c* and pin through-hole 134. Washer 172 is placed onto the first end surface 162*a* of first pin half 162 such that washer 172 is aligned with through-hole 164 and such that a portion of washer 172 rests on the exterior surface of main tube 122. Bolt 174 may then be inserted through washer 172 and through-hole 164. Second pin half 166 may be inserted through pin through-hole 124*c* and pin through-hole 134 such that threaded hole 168 is aligned with through-hole 164 and protrusion 176 rests on an exterior surface of main tube 122 that is opposite and parallel to the surface on which washer 172 is seated. Bolt 174 may then be threaded into threaded hole 168 and tightened, holding main tube 122 and base tube 132 together.

Referring back to FIGS. 3 through 5, in aspects, leg assembly 120 may be height adjustable. Base tube 132 may define a number of pin through-holes 134 disposed through base tube 132 between bottom end surface 132*b* and top end surface 132*a*. Pin through-hole 124*c* may correspond to any of the number of pin through-holes 134. Therefore, leg assembly 120 may be made taller or shorter as required depending upon which pin through-hole 134 pin assembly 160 is inserted into.

In further aspects, there may be two points of connection between main tube 122 and base tube 132. Main tube 122 may have a first pin through-hole 124*c* disposed through main tube 122 and a second pin through-hole 124*c* perpendicular to the first pin through-hole 124*c* disposed at a different height through main tube 122. Base tube 132 may have a first group of pin through-holes 134 disposed through base tube 132 moving from bottom end surface 132*b* to a midpoint of base tube 132, each corresponding to first pin through-hole 124*c*. Perpendicular to the first group of pin through-holes 134 and moving from the midpoint of base tube 132 to top end surface 132*a*, a second group of pin through-holes 134 may be disposed through base tube 132, each corresponding to second pin through-hole 124*c*. Main tube 122 and base tube 132 may be connected by inserting a first pin assembly 160 through first pin through-hole 124*c* and a pin through-hole of the first group of pin through-holes 134, then inserting second pin assembly 160 through second pin through-hole 124*c* and a pin through-hole of the second group of pin through-holes 134.

Once main tube 122 and base tube 132 are connected via pin assembly 160, leg assembly 120 may be stood vertically on a surface (e.g., a ground surface). Bottom surface 136*b* of base plate 136 is in contact with the surface and forms a first horizontal plane. Base plate 136 may be secured to the surface, such as by mechanical fastening or any other suitable securement technique. Top surface 128*a* of head plate 128 is parallel to the first horizontal plane.

As noted earlier, main tube 122 includes upper through-hole 124*a* and lower through-hole 124*b* disposed through top portion 122*b* of main tube 122. Each of upper through-hole 124*a* and lower through-hole 124*b* may be configured to receive a threaded insert 126. Threaded insert 126 may be comprised of any suitable rigid material such as a metallic material like steel or carbon steel, and may include plating, for example, cadmium plating, to increase corrosion resistance. In aspects, upper through-hole 124*a* and lower through-hole 124*b* may be countersunk, and threaded insert 126 may include a countersunk head, such that when threaded insert 126 is received by upper through-hole 124*a* and lower through-hole 124*b*, threaded insert 126 is flush with the exterior surface of main tube 122. Threaded insert 126 is threaded, and sized such that bolt 154 may be inserted into threaded insert 126. Threaded insert 126 provides the benefit of ease of assembly and allows for arch assembly 140 to be fastened to leg assembly 120 via bolt 154 without the need to fasten a nut onto bolt 154. Threaded insert 126 additionally provides increased contact between threads of threaded insert 126 and bolt 154, thereby increasing the strength of the connection between threaded insert 126 and bolt 154, and the stability of scaffolding system 100.

Figure 7:
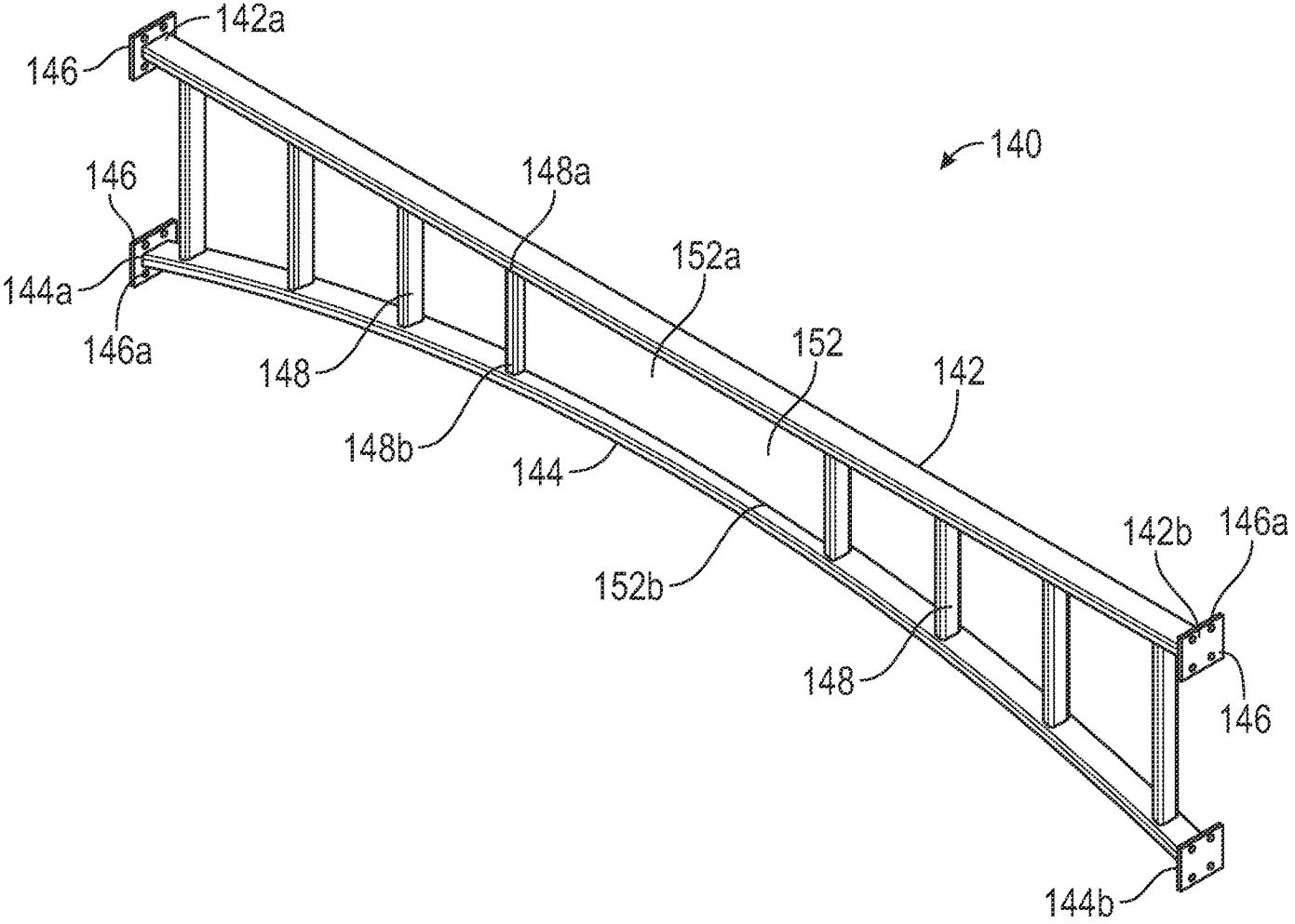
FIG. 7 is a top perspective view of an arch assembly of the scaffolding system of FIG. 1.

With reference to FIG. 7, arch assembly 140 of scaffolding system 100 generally includes a top chord 142, a bottom chord 144, and one or more vertical members 148. Top chord 142 includes a first end 142*a* and a second end 142*b*, and bottom chord 144 includes a first end 144*a* and a second end 144*b*. Each of first end 142*a*, second end 142*b*, first end 144*a*, and second end 144*b* may have an end plate 146 disposed thereon. End plate 146 may be attached to top chord 142 and bottom chord 144 using any suitable securement technique such as welding, mechanical fastening, adhesive bonding, or the like. Once attached to top chord 142 and bottom chord 144, end plate 146 is parallel to the exterior surface of main tube 122. End plate 146 includes through-hole(s) 146*a*, with through-hole 146*a* sized to receive bolt 154 therethrough. In aspects, top chord 142 and bottom chord 144 are not attached to end plate 146. Rather, first end 142*a* and second end 142*b* of top chord 142 and first end 144*a* and second end 144*b* of bottom chord 144 may each be parallel to the exterior surface of main tube 122 and may each include through-hole 146*a* sized to receive bolt 154 therethrough.

First end 144*a* and second end 144*b* of bottom chord 144 define a second horizontal plane. In aspects, top chord 142 is straight across and bottom chord 144 is curved such that a vertex of bottom chord 144 is located above the second horizontal plane at a center point of the bottom chord 144, e.g., an arch configuration. The arch configuration of bottom chord 144 provides the benefit of enabling the scaffolding system 100 to hold more weight than a straight configuration with parallel horizontal members. Bottom chord 144 may take on other shapes, for example, it is contemplated that bottom chord 144 may be straight across or may be angled in a triangular manner, with the second horizontal plane defining a bottom side of the triangle.

Each vertical member 148 includes a top end 148*a* and a bottom end 148*b*. The top end 148*a* of vertical member 148 is configured to connect to the top chord 142 and the bottom end 148*b* of vertical member 148 is configured to connect to the bottom chord 144. Vertical member 148 may be connected to top chord 142 and bottom chord 144 using any suitable securement technique such as welding, mechanical fastening, adhesive bonding, or the like. It is further contemplated that top chord 142 and bottom chord 144 may each include one or more slots (not shown) such that vertical members 148 may be press-fit into the one or more slots. Vertical members 148 connect at locations of top chord 142 and bottom chord 144 such that first end 142*a* of top chord 142 and first end 144*a* of bottom chord 144 are vertically aligned, and such that second end 142*b* of top chord 142 and second end 144*b* of bottom chord 144 are vertically aligned.

Vertical members 148 may be connected to top chord 142 and bottom chord 144 in increments moving from first ends 142*a*, 144*a* to second ends 142*b*, 144*b*. In aspects, when bottom chord 144 is of a curved configuration, each vertical member 148 may decrease in vertical length moving from first end 144*a* of the bottom chord 144 to the vertex of bottom chord 144. Then, moving from the vertex of bottom chord 144 to second end 144*b* of bottom chord 144, each vertical member 148 may increase in vertical length. That is, the vertical length of each vertical member 148 moving from first end 144*a* to second end 144*b* of bottom chord 144 may change such that each bottom end 148*b* of vertical member 148 traces a profile of bottom chord 144. Bottom end 148*b* of each vertical member 148 may be angled to further aid in tracing the profile of bottom chord 144.

In aspects, arch assembly 140 may further include a panel 152. Panel 152 includes a top end 152*a* and a bottom end 152*b*. Top end 152*a* is configured to connect to top chord 142 and bottom end 152*b* is configured to connect to bottom chord 144. Panel 152 may be connected to top chord 142 and bottom chord 144 using any suitable securement technique such as welding, mechanical fastening, adhesive bonding, or the like. It is further contemplated that top chord 142 and bottom chord 144 may each include a slot (not shown) such that panel 152 may be press-fit into the slot. Panel 152 may be disposed at a central location of both top chord 142 and bottom chord 144. Panel 152 may further be bounded by top chord 142, bottom chord 144, and vertical members 148.

In aspects, panel 152 may be removably connected to top chord 142 and bottom chord 144. Panel 152 may be a structural member, or may be used decoratively. For example, panel 152 may display a logo or a pattern. In aspects, the logo or pattern may be printed on, drawn on, painted on, or otherwise applied to panel 152. In further aspects, the logo or pattern may be formed by cutting a portion of panel 152 away, such as by laser cutting. In additional aspects, panel 152 may comprise an electronic display, which may display a logo, pattern, video, or the like.

Figure 8:
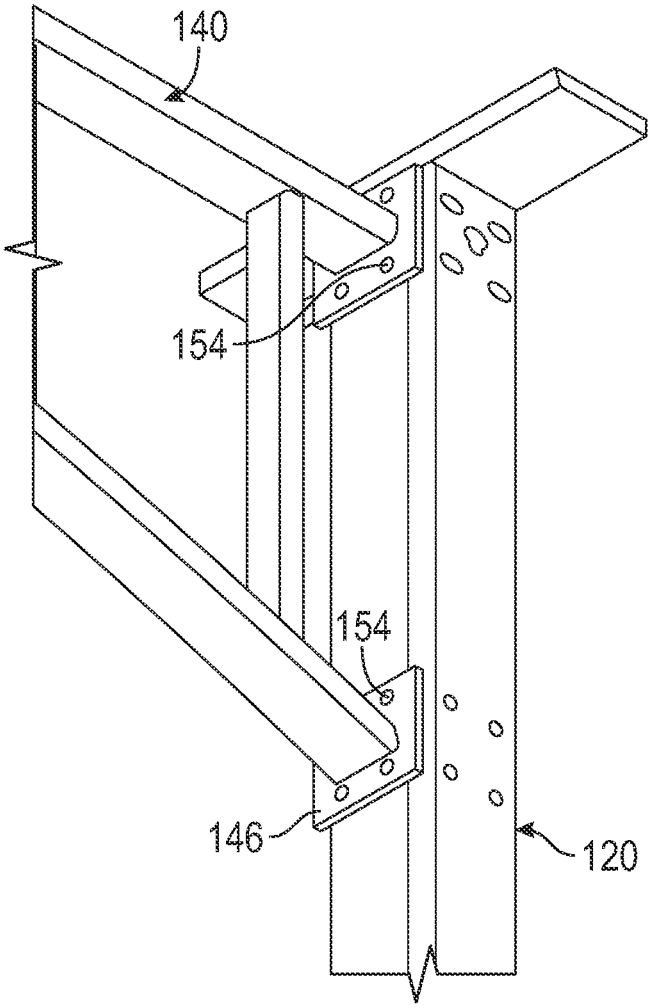
FIG. 8 is an enlarged view of a connection between the leg assembly of FIG. 3 and the arch assembly of FIG. 7.

To assemble scaffolding system 100, bolt 154 is inserted into each through-hole 146*a* of arch assembly 140, then inserted into each threaded insert 126 disposed in upper through-hole 124*a* and lower through-hole 124*b* of leg assembly 120 and tightened. A leg assembly 120 is thus attached at each end of arch assembly 140, with two connection points between arch assembly 140 and each leg assembly 120. With reference to FIG. 8, an enlarged view of a connection between leg assembly 120 and arch assembly 140 is shown. In aspects, main tube 122 may include upper through-holes 124*a* and lower through-holes 124*b* on all surfaces of main tube 122, allowing for an arch assembly 140 to be connected to all surfaces of main tube 122. In aspects, it is contemplated that scaffolding system 100 may include additional through-holes containing threaded inserts in each leg assembly 120, and each arch assembly 140 may include additional chords for connection to said additional through-holes.

Figure 10A:
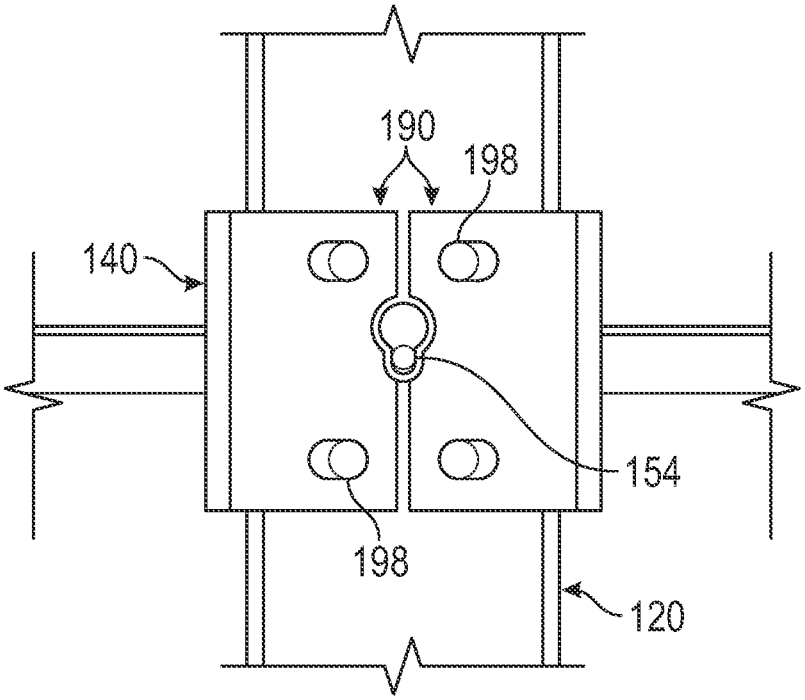
FIG. 10A is a side perspective view of an alternative connection between the leg assembly of FIG. 3 and the arch assembly of FIG. 7, including a bracket.
Figure 10B:
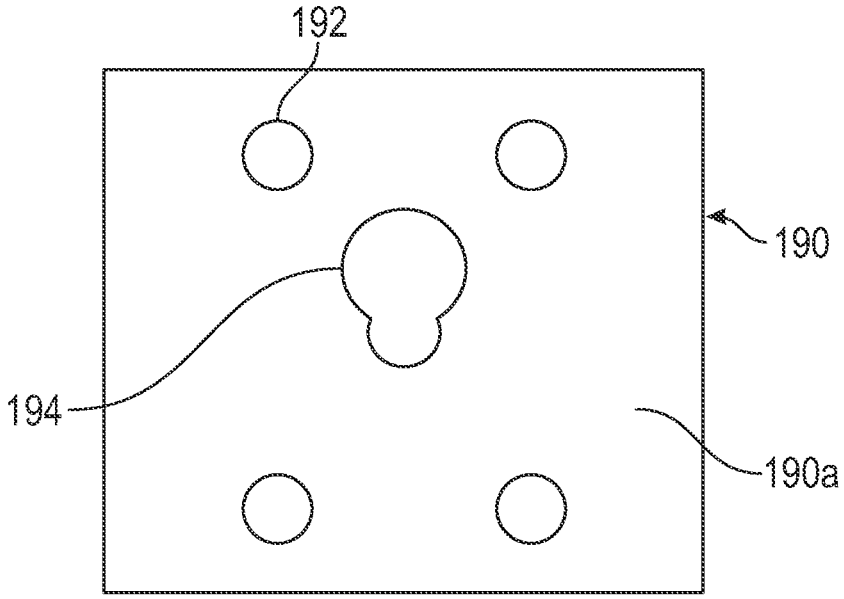
FIG. 10B is a front view of the bracket of FIG. 10A.
Figure 10C:
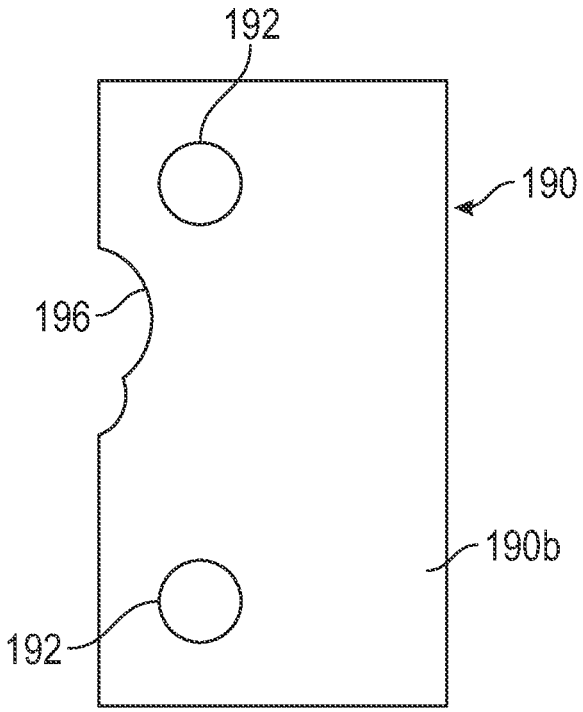
FIG. 10C is a left side view of the bracket of FIG. 10A.
Figure 10D:
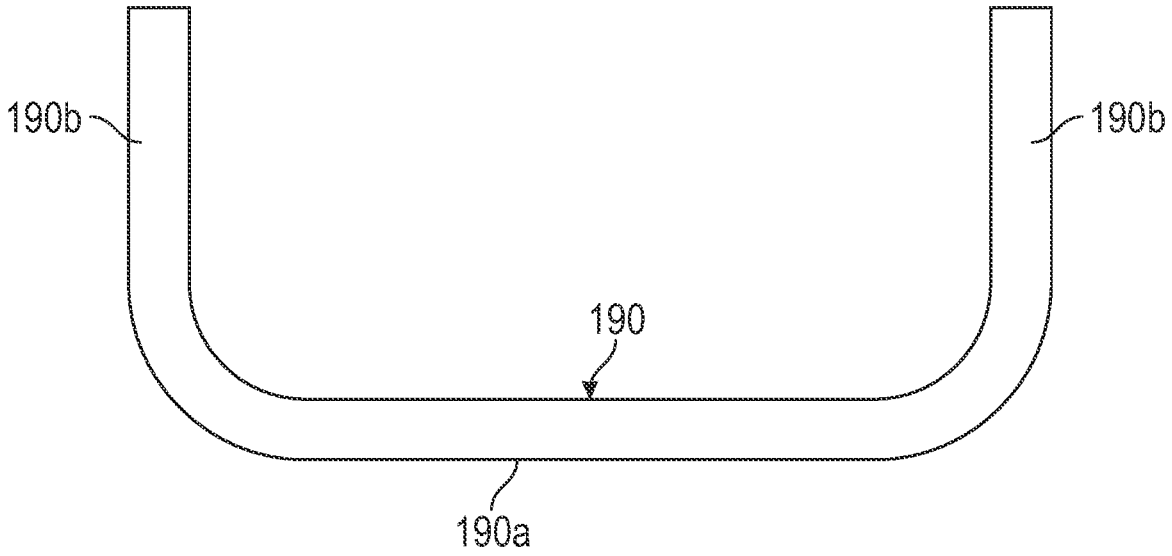
FIG. 10D is a top view of the bracket of FIG. 10A.

Alternatively, leg assembly 120 may not include threaded inserts 126. Arch assembly 140 and leg assembly 120 may be connected using a bracket 190, as shown in FIGS. 10A through 10D. Bracket 190 may wrap around approximately half of leg assembly 120, and may include front face 190*a* and side face(s) 190*b*. Front face 190*a* of bracket 190 may include bracket through-hole(s) 192, which are located to overlap either upper through-holes 124*a* of main tube 122 or lower through-holes 124*b* of main tube 122, as well as through-holes 146*a* of arch assembly 140, when bracket 190 is disposed on main tube 122 for assembly. Bracket 190 may include an elongated through-hole 194, which profiles elongated through-hole 124*d* of main tube 122. In aspects, elongated through-hole 194 of bracket 190 may be larger than elongated through-hole 124*d* of main tube 122. Side face(s) 190*b* of bracket 190 may include bracket through-hole(s) 192, and additionally may include cutout 196. Cutout 196 may partially profile elongated through-hole 124*d* of main tube 122, and may be larger than elongated through-hole 124*d* of main tube 122. In further aspects, a first bracket 190 may be installed a first side of main tube 122, and a second bracket 190 may be installed on a second side of main tube 122, such that together, cutout 196 of first side face 190*b* of first bracket 190 and cutout 196 of second side face 190*b* of second bracket 190 form an approximately complete outline of elongated through-hole 124*d* of main tube 122, as shown in FIG. 10A in particular.

To assemble scaffolding system 100, bracket through-holes 192 and elongated through-hole 194 of bracket 190 are first aligned with upper through-holes 124*a* and elongated through-hole 124*d* of main tube 122 of leg assembly 120. Bracket 190 may be secured via elongated through-hole 194 using any suitable fastener, such as bolt 154. For example, a head of bolt 154 may be inserted through the first circle of elongated through-hole 124*d* and elongated through-hole 194. A body portion of bolt 154 may then be slid into the second circle of elongated through-hole 124*d* and elongated through-hole 194. With the head of bolt 154 captured in an interior area of main tube 122, a nut (not shown) may be threaded onto the body portion of bolt 154, holding bracket 190 and leg assembly 120 together.

With leg assembly 120 and bracket 190 connected, through-holes 146*a* of arch assembly 140 may be aligned with bracket through-holes 192 of bracket 190 and upper through-holes 124*a* or lower through-holes 124*b* of leg assembly 120, and a fastener 198 may be inserted therethrough. The fastener 198 may be a bolt, a headless screw, or any other suitable fastener, and may be secured with a nut (not shown). In aspects, when the first bracket 190 and the second bracket 190 are disposed on the first side and the second side of main tube 122 of leg assembly 120, respectively, fastener 198 may be inserted through both the first bracket 190 and the second bracket 190, such that an arch assembly 140 may be connected to each of the first bracket 190 and the second bracket 190 using the same fastener 198.

Once each end of each arch assembly 140 is connected to a leg assembly 120, in aspects, a central vertical axis of each leg assembly 120 may be at least ten feet apart from the central vertical axis of each remaining leg assembly 120. In further aspects, a clearance height of at least eight feet may be established beneath each arch assembly 140, measured between the first horizontal plane (i.e., the ground surface) and the second horizontal plane. This spacing and clearance height provides the benefit of meeting the requirements defined, for example, in New York City Building Codes 3307.6.4.4 and 3307.6.4.7. In aspects, a false ceiling (e.g., ceiling tile) may removably rest on top chord 142 of each arch assembly 140 (not shown). The false ceiling may be decorative, and may include a logo or pattern.

In aspects, leg assemblies 120 and arch assemblies 140 may be arranged in a grid pattern, where deck 180 may be seated on top end 128*a* of head plate 128 of each leg assembly 120. Deck 180 may alternatively be mechanically fastened to leg assembly 120. Arch assembly 140 provides superior structural support and aids in distributing a weight of deck 180 throughout scaffolding system 100. In fact, scaffolding system 100 meets and exceeds point load and uniform ratings of about three-hundred pounds-per-square-foot up to about fifteen-foot spans of arch assembly 140.

Figure 9:
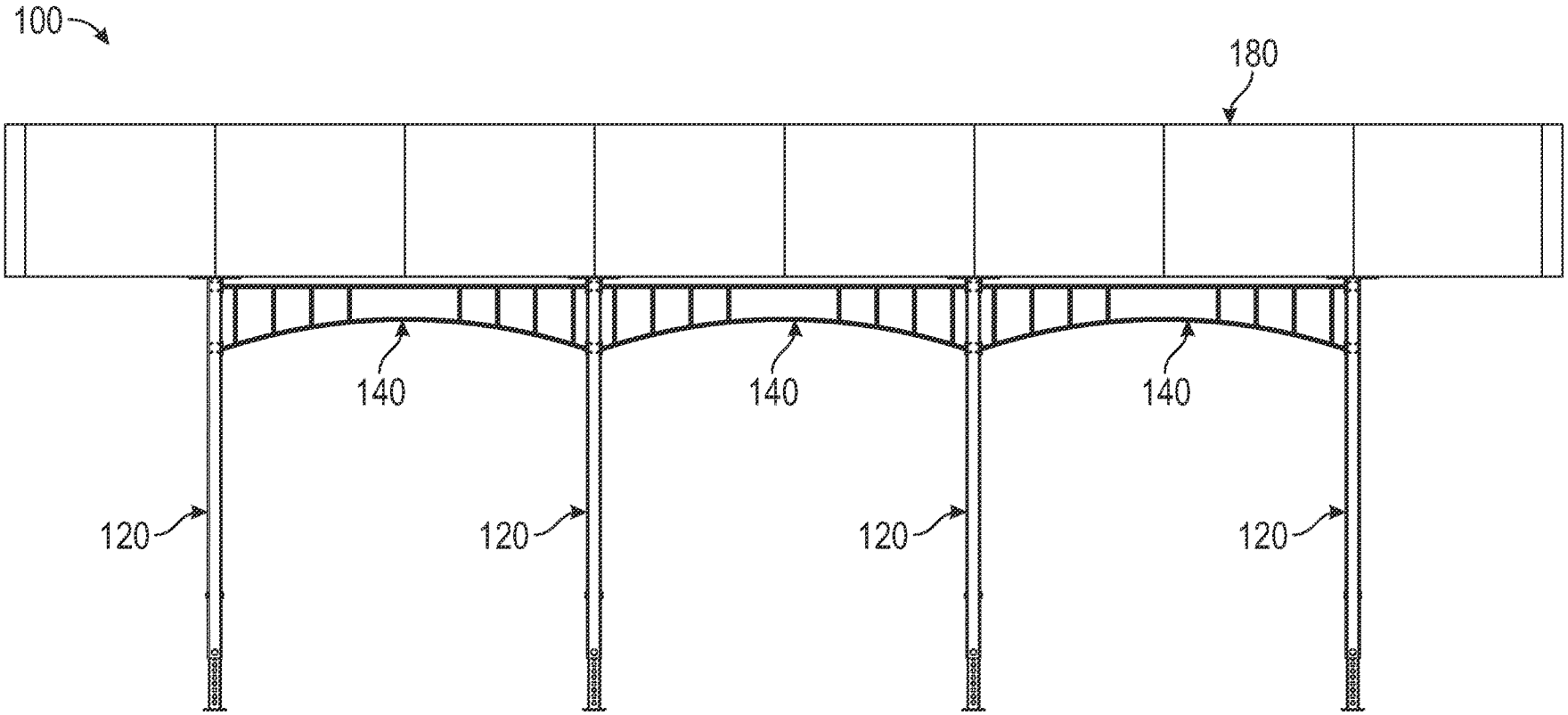
FIG. 9 is a side view of a multiple bay scaffolding system in accordance with aspects of the present disclosure.

A single bay configuration of scaffolding system 100 (FIGS. 1 and 2) may be comprised of four leg assemblies 120 and four arch assemblies 140 arranged in a quadrilateral formation. However, it is contemplated that scaffolding system 100 may constitute a configuration in which multiple bays are connected, as shown in FIG. 9.

Certain aspects of the present disclosure may include some, all, or none of the above advantages and/or one or more other advantages readily apparent to those skilled in the art from the drawings, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate aspects, each of the aspects herein may be combined with one or more of the other aspects herein. Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an aspect," "in aspects," "in various aspects," "in some aspects," or "in other aspects" may each refer to one or more of the same or different example Aspects provided in the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A scaffolding system, comprising:

a plurality of leg assemblies, each leg assembly of the plurality of leg assemblies including a top end surface and a bottom end surface, wherein each leg assembly of the plurality of leg assemblies defines a plurality of through-holes disposed in a top end portion, wherein each leg assembly of the plurality of leg assemblies defines a plurality of elongated through-holes disposed in a top end portion, wherein each of the plurality of elongated through-holes is shaped to include a first circle overlapping a second circle, wherein the first circle is larger than the second circle, wherein each leg assembly of the plurality of leg assemblies includes a head plate disposed on the top end surface of the leg assembly, each leg assembly of the plurality of leg assemblies further including at least one bracket, wherein each bracket includes:

a front face, wherein the front face defines a first bracket through-hole configured to overlap a first through-hole of the plurality of through-holes of the leg assembly, wherein the front face defines an elongated bracket through-hole configured to overlap a first elongated through-hole of the plurality of elongated through-holes of the leg assembly, a first side face defining a second bracket through-hole configured to overlap a second through-hole of the plurality of through-holes of the leg assembly, wherein the first side face further defines a first cutout configured to at least partially profile a second elongated through-hole of the plurality of elongated through-holes of the leg assembly, and a second side face defining a third bracket through-hole configured to overlap a third through-hole of the plurality of through-holes of the leg assembly, wherein the second side face further defines a second cutout configured to at least partially profile a third elongated through-hole of the plurality of elongated through-holes of the leg assembly, wherein, when mirrored, the first cutout and the second cutout respectively form an approximately complete outline of the second elongated through-hole of the leg assembly and the third elongated through-hole of the leg assembly;

a plurality of arch assemblies, each arch assembly of the plurality of arch assemblies comprising a top chord, a bottom chord, and a plurality of vertical members, wherein:

the top chord includes a first end and a second end, the bottom chord includes a first end and a second end, each vertical member of the plurality of vertical members includes a top end and a bottom end, wherein the top chord connects to the top end of each vertical member of the plurality of vertical members and the bottom chord connects to the bottom end of each vertical member of the plurality of vertical members such that the first end of the top chord and the first end of the bottom chord are vertically aligned and the second end of the top chord and second end of the bottom chord are vertically aligned, wherein at least one of the first end of the top chord or the first end of the bottom chord is configured to connect to a first leg assembly of the plurality of leg assemblies via a through-hole of the at least one plurality of through-holes of the first leg assembly, wherein at least one of the second end of the top chord or the second end of the bottom chord is configured to connect to a second leg assembly of the plurality of leg assemblies via a through-hole of the at least one plurality of through-holes of the second leg assembly; and a deck, wherein the plurality of leg assemblies is configured to support a plurality of the deck on the head plate of each of the plurality of leg assemblies, and wherein the deck extends past the plurality of leg assemblies in all directions.

2. The scaffolding system of claim 1, wherein each leg assembly of the plurality of leg assemblies includes a square horizontal cross-section.

3. The scaffolding system of claim 1, wherein each leg assembly of the plurality of leg assemblies includes an adjustable height.

4. The scaffolding system of claim 1, wherein a central vertical axis of each leg assembly of the plurality of leg assemblies is placed at least ten feet apart from the central vertical axis of each remaining leg assembly of the plurality of leg assemblies.

5. The scaffolding system of claim 1, wherein each arch assembly further comprises a panel, wherein:

the panel includes a top end and a bottom end, and the panel is disposed at a central location of both the top chord and the bottom chord, the top end of the panel connecting to the top chord and the bottom end of the panel connecting to the bottom chord.

6. The scaffolding system of claim 1, wherein the bottom end surface of each leg assembly of the plurality of leg assemblies defines a first horizontal plane, the first end of the bottom chord and the second end of the bottom chord define a second horizontal plane, and a clearance height of at least eight feet is established beneath each arch assembly of the plurality of arch assemblies between the first horizontal plane and the second horizontal plane.

7. The scaffolding system of claim 1, wherein:

the first end of the bottom chord and the second end of the bottom chord define a horizontal plane, the bottom chord is curved such that a vertex of the bottom chord is located above the horizontal plane at a center point of the bottom chord, and each vertical member of the plurality of vertical members decreases in vertical length moving from the first end of the bottom chord to the center point of the bottom chord and increases in vertical length moving from the center point of the bottom chord to the second end of the bottom chord.

8. The scaffolding system of claim 1, wherein:

the first end of the top chord includes a first end plate disposed thereon, the second end of the top chord includes a second end plate disposed thereon, the first end of the bottom chord includes a first end plate disposed thereon, the second end of the bottom chord includes a second end plate disposed thereon, wherein at least one of the first end of the top chord or the first end of the bottom chord connects to a through-hole of the plurality of through-holes of the first leg assembly of the plurality of leg assemblies via at least one of the first end plate of the top chord or the first end plate of the bottom chord, and wherein at least one of the second end of the top chord or the second end of the bottom chord connects to a through-hole of the plurality of through-holes of the second leg assembly of the plurality of leg assemblies via at least one of the second end plate of the top chord or the second end plate of the bottom chord.

9. The scaffolding system of claim 1, wherein each through-hole of the plurality of the through-holes of each leg assembly of the plurality of leg assemblies is configured to receive a threaded insert, and wherein:

at least one of the first end of the top chord or the first end of the bottom chord connects to the first leg assembly of the plurality of leg assemblies via the threaded insert, and at least one of the second end of the top chord or the second end of the bottom chord connects to the second leg assembly of the plurality of leg assemblies via the threaded insert.

10. The scaffolding system of claim 1, wherein the top end surface and the bottom end surface of each leg assembly of the plurality of leg assemblies are parallel.

11. The scaffolding system of claim 1, wherein the plurality of leg assemblies and the plurality of arch assemblies are arranged in a grid pattern.

12. The scaffolding system of claim 1, further comprising a plurality of false ceiling sections, wherein the plurality of arch assemblies is configured to support the plurality of false ceiling sections.

13. A scaffolding system, comprising:

a plurality of leg assemblies, each leg assembly of the plurality of leg assemblies including a top end surface and a bottom end surface, wherein the top end surface and bottom end surface are parallel, wherein:

each leg assembly of the plurality of leg assemblies includes a head plate disposed on the top end surface of the leg assembly, each leg assembly of the plurality of leg assemblies includes a plurality of upper through-holes and a plurality of lower through-holes disposed in a top end portion, each of the plurality of upper through-holes and the plurality of lower through-holes are configured to receive a threaded insert, each leg assembly of the plurality of leg assemblies defines a plurality of elongated through-holes disposed in the top end portion, wherein each of the plurality of elongated through-holes is shaped to include a first circle overlapping a second circle, wherein the first circle is larger than the second circle, and each leg assembly of the plurality of leg assemblies further includes at least one bracket, wherein each bracket includes:

a front face, wherein the front face defines a first bracket through-hole configured to overlap at least one of a first upper-through hole of the plurality of upper through-holes of the leg assembly or a first lower through-hole of the plurality of lower through-holes of the leg assembly, wherein the front face defines an elongated bracket through-hole configured to overlap a first elongated through-hole of the plurality of elongated through-holes of the leg assembly, a first side face defining a second bracket through-hole configured to overlap at least one of a second upper through-hole of the plurality of upper through-holes of the leg assembly or a second lower through-hole of the plurality of lower through-holes of the leg assembly, wherein the first side face further defines a first cutout configured to at least partially profile a second elongated through-hole of the plurality of elongated through-holes of the leg assembly, and a second side faces defining a third bracket through-hole configured to overlap at least one of a third upper through-hole of the plurality of upper through-holes of the leg assembly or a third lower through-hole of the plurality of lower through-holes of the leg assembly, wherein the second side face further defines a second cutout configured to at least partially profile a third elongated through-hole of the plurality of elongated through-holes of the leg assembly, wherein, when mirrored, the first cutout and the second cutout respectively form an approximately complete outline of the second elongated through-hole of the leg assembly and the third elongated through-hole of the leg assembly;

a plurality of arch assemblies, each arch assembly of the plurality of arch assemblies comprising a top chord, a bottom chord, and a plurality of vertical members, wherein:

the top chord includes a first end and a second end, the first end of the top chord including a first end plate disposed thereon and the second end of the top chord including a second end plate disposed thereon, the bottom chord includes a first end and a second end, the first end of the bottom chord including a first end plate disposed thereon and the second end of the bottom chord including a second end plate disposed thereon, the first end of the bottom chord and the second end of the bottom chord defining an upper horizontal plane, each vertical member of the plurality of vertical members includes a top end and a bottom end, wherein the top chord connects to the top end of each vertical member of the plurality of vertical members and the bottom chord connects to the bottom end of each vertical member of the plurality of vertical members such that the first end plate of the top chord and the first end plate of the bottom chord are vertically aligned and the second end plate of the top chord and second end plate of the bottom chord are vertically aligned, wherein the bottom chord is curved such that a vertex of the bottom chord is located above the upper horizontal plane at a center point of the bottom chord, wherein each vertical member of the plurality of vertical members decreases in vertical length moving from the first end of the bottom chord to the center point of the bottom chord and increases in vertical length moving from the center point of the bottom chord to the second end of the bottom chord, wherein the first end plate of the top chord is configured to connect to a first leg assembly of the plurality of leg assemblies via the threaded insert of an upper through-hole of the plurality of upper through-holes and the first end plate of the bottom chord is configured to connect to the first leg assembly of the plurality of leg assemblies via the threaded insert of a lower through-hole of the plurality of lower through-holes, wherein the second end plate of the top chord is configured to connect to a second leg assembly of the plurality of leg assemblies via the threaded insert of an upper through-hole of the plurality of upper through-holes and the second end plate of the bottom chord is configured to connect to the second leg assembly of the plurality of leg assemblies via the threaded insert of a lower through-hole of the plurality of lower through-holes; and a deck, wherein the plurality of leg assemblies is configured to support the deck on the head plate of each of the plurality of leg assemblies, and wherein the deck extends past the plurality of leg assemblies in all directions.

14. The scaffolding system of claim 13, wherein each leg assembly of the plurality of leg assemblies includes a square horizontal cross-section.

15. The scaffolding system of claim 13, wherein each leg assembly of the plurality of leg assemblies further comprises a pin assembly, a main tube including a pin through-hole, and a base tube including a plurality of pin through-holes, wherein:

the pin assembly is configured to be received by the pin through-hole of the main tube and a pin through-hole of the plurality of pin through-holes of the base tube, and wherein a height of each leg assembly of the plurality of leg assemblies is adjusted by:

aligning the pin through-hole of the main tube with a pin through-hole of the plurality of pin through-holes of the base tube, and installing the pin assembly within the pin through-hole of the main tube and the pin through-hole of the plurality of pin through-holes of the base tube.

16. The scaffolding system of claim 13, wherein a central vertical axis of each leg assembly of the plurality of leg assemblies is placed at least ten feet apart from the central vertical axis of each remaining leg assembly of the plurality of leg assemblies.

17. The scaffolding system of claim 13, wherein each arch assembly further comprises a panel, wherein:

the panel includes a top end and a bottom end, and the panel is disposed at a central location of both the top chord and the bottom chord, the top end of the panel connecting to the top chord and the bottom end of the panel connecting to the bottom chord.

18. The scaffolding system of claim 13, wherein the bottom end surface of each leg assembly of the plurality of leg assemblies defines a lower horizontal plane, and a clearance height of at least eight feet is established beneath each arch assembly of the plurality of arch assemblies between the upper horizontal plane and the lower horizontal plane.

19. The scaffolding system of claim 13, wherein the plurality of leg assemblies and the plurality of arch assemblies are arranged in a grid pattern.

20. A scaffolding system, comprising:

a plurality of leg assemblies, each leg assembly of the plurality of leg assemblies including a top end surface and a bottom end surface, wherein the bottom end surface defines a first horizontal plane and wherein the top end surface and bottom end surface are parallel, each leg assembly of the plurality of leg assemblies including a square horizontal cross-section, and wherein:

a central vertical axis of each leg assembly of the plurality of leg assemblies is placed at least ten feet apart from the central vertical axis of each remaining leg assembly of the plurality of leg assemblies, each leg of the plurality of leg assemblies includes a plurality of upper through-holes and a plurality of lower through-holes disposed in a top end portion, each leg assembly of the plurality of leg assemblies defines a plurality of elongated through-holes disposed in the top end portion, wherein each of the plurality of elongated through-holes is shaped to include a first circle overlapping a second circle, wherein the first circle is larger than the second circle, each leg assembly of the plurality of leg assemblies further includes at least one bracket, wherein each bracket includes:

a front face, wherein the front face defines a first bracket through-hole configured to overlap at least one of a first upper through-hole of the plurality of upper through-holes of the leg assembly or a first lower through-hole of the plurality of lower through-holes of the leg assembly, wherein the front face defines an elongated bracket through-hole configured to overlap a first elongated through-hole of the plurality of elongated through-holes of the leg assembly, a first side face defining a second bracket through-hole configured to overlap at least one of a second upper through-hole of the plurality of upper through-holes of the leg assembly or a second lower through-hole of the plurality of lower through-holes of the leg assembly, wherein the first side face further defines a first cutout configured to at least partially profile a second elongated through-hole of the plurality of elongated through-holes of the leg assembly, and a second side faces defining a third bracket through-hole configured to overlap the at least one of a third upper through-hole of the plurality of upper through-holes of the leg assembly or a third lower through-hole of the plurality of lower through-holes of the leg assembly, wherein the second side face further defines a second cutout configured to at least partially profile a third elongated through-hole of the plurality of elongated through-holes of the leg assembly, wherein, when mirrored, the first cutout and the second cutout respectively form an approximately complete outline of the second elongated through-hole of the leg assembly and the third elongated through-hole of the leg assembly, wherein each of the plurality of upper through-holes and the plurality of lower through-holes includes a threaded insert therein, and wherein each leg assembly of the plurality of leg assemblies further comprises a first pin assembly, a second pin assembly, a main tube including a first pin through-hole and a second pin through-hole, the second pin through-hole being disposed perpendicular to and below the first pin through-hole, and a base tube including a plurality of first pin through-holes and a plurality of second pin through-holes, the plurality of second pin through-holes being disposed perpendicular to and below the plurality of first pin through-holes, wherein:

the first pin assembly is configured to be received by the first pin through-hole of the main tube and a pin through-hole of the plurality of first pin through-holes of the base tube, the second pin assembly is configured to be received by the second pin through-hole of the main tube and a pin through-hole of the plurality of second pin through-holes of the base tube, and wherein a height of each leg assembly of the plurality of leg assemblies is adjusted by:

aligning the first pin through-hole of the main tube with a pin through-hole of the plurality of first pin through-holes of the base tube, aligning the second pin through-hole of the main tube with a pin through-hole of the plurality of second pin through-holes of the base tube, installing the first pin assembly within the first pin through-hole of the main tube and the pin through-hole of the plurality of first pin through-holes of the base tube, and installing the second pin assembly within the second pin through-hole of the main tube and the pin through-hole of the plurality of second pin through-holes of the base tube; and a plurality of arch assemblies, each arch assembly of the plurality of arch assemblies comprising a top chord, a bottom chord, a panel, and a plurality of vertical members, wherein:

the top chord includes a first end and a second end, the first end of the top chord including a first end plate disposed thereon and the second end of the top chord including a second end plate disposed thereon, the bottom chord includes a first end and a second end, the first end of the bottom chord including a first end plate disposed thereon and the second end of the bottom chord including a second end plate disposed thereon, the first end of the bottom chord and the second end of the bottom chord defining a second horizontal plane, the panel includes a top end and a bottom end, each vertical member of the plurality of vertical members includes a top end and a bottom end, wherein the top chord connects to the top end of each vertical member of the plurality of vertical members and the bottom chord connects to the bottom end of each vertical member of the plurality of vertical members such that the first end plate of the top chord and the first end plate of the bottom chord are vertically aligned and the second end plate of the top chord and second end plate of the bottom chord are vertically aligned, wherein the bottom chord is curved such that a vertex of the bottom chord is located above the second horizontal plane at a center point of the bottom chord, wherein each vertical member of the plurality of vertical members decreases in vertical length moving from the first end of the bottom chord to the center point of the bottom chord and increases in vertical length moving from the center point of the bottom chord to the second end of the bottom chord, wherein the panel is disposed at a central location of both the top chord and the bottom chord, the top end of the panel connecting to the top chord and the bottom end of the panel connecting to the bottom chord, wherein the first end plate of the top chord connects to a first leg assembly of the plurality of leg assemblies via the threaded insert of an upper through-hole of the plurality of upper through-holes and the first end plate of the bottom chord connects to the first leg assembly of the plurality of leg assemblies via the threaded insert of a lower through-hole of the plurality of lower through-holes, wherein the second end plate of the top chord connects to a second leg assembly of the plurality of leg assemblies via the threaded insert of an upper through-hole of the plurality of upper through-holes and the second end plate of the bottom chord connects to the second leg assembly of the plurality of leg assemblies via the threaded insert of a lower through-hole of the plurality of lower through-holes, and wherein a clearance height of at least eight feet is established beneath each arch assembly of the plurality of arch assemblies between the first horizontal plane and the second horizontal plane; and a deck, wherein the plurality of leg assemblies and the plurality of arch assemblies are arranged in a grid pattern, wherein the plurality of leg assemblies is configured to support the deck, wherein the deck extends past the plurality of leg assemblies in all directions, and wherein the plurality of arch assemblies is configured to support a plurality of false ceiling sections.

* * * * *